United States Patent [19]

Unger

[11] Patent Number: 4,689,142

[45] Date of Patent: Aug. 25, 1987

[54] ALKYL MERCAPTANS AS COLLECTOR ADDITIVES IN FROTH FLOTATION

[75] Inventor: Kim N. Unger, Tucson, Ariz.

[73] Assignee: Essex Industrial Chemicals, Inc., Clifton, N.J.

[21] Appl. No.: 714,832

[22] Filed: Mar. 22, 1985

[51] Int. Cl.[4] ..... B03D 1/14

[52] U.S. Cl. ..... 209/166; 252/61

[58] Field of Search ..... 209/166, 167; 252/61; 75/2

[56] References Cited

U.S. PATENT DOCUMENTS

| | | | |
|---|---|---|---|
| 2,412,500 | 12/1946 | Fischer | 209/166 |
| 3,925,218 | 12/1975 | Zipperian et al. | 209/167 |
| 4,387,034 | 6/1983 | Unger et al. | 209/166 |
| 4,439,314 | 3/1984 | Parlman et al. | 209/167 |
| 4,518,492 | 5/1985 | Bresson et al. | 252/61 |

*Primary Examiner*—Bernard Nozick

*Attorney, Agent, or Firm*—Harry M. Weiss

[57] ABSTRACT

A method and product for concentrating metal values from their ores employing alkyl mercaptans as collector additives in froth flotation, wherein there is provided a mixture of (I) a collector selected from the class consisting of at least one of (A) an alkyl xanthogen alkyl formate compound having the general formula:

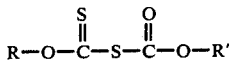

wherein R is a branched or straight chain alkyl substituent having 1 to 6 carbon atoms and R′ is selected from the class consisting of one of ethyl and methyl; and (B) a dialkyl thionocarbamate compound having the formula:

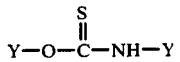

wherein Y is a branched or straight chain alkyl substituent having 1 to 6 carbon atoms and Y′ is selected from the class consisting of one of ethyl and ethyl; and (II) an alkyl mercaptan having the formula:

Z—SH wherein Z is a branched or straight chain alkyl substituent having 4 to 16 carbon atoms. Isobutyl xanthogen ethyl formate, N-methyl-O-ethyl thionocarbamate and dodecyl mercaptan are illustrative. The method is particularly satisfactory for collecting copper, lead, zinc, molybdenum sulfide and precious metals.

11 Claims, No Drawings

ALKYL MERCAPTANS AS COLLECTOR ADDITIVES IN FROTH FLOTATION

BACKGROUND OF THE INVENTION

This invention relates generally to ore dressing methods and to the beneficiation of metal values in ores by flotation. More particularly, this invention provides a new and significant method for recovering metal values from ores by forth flotation of an ore slurry in the presence of a mixture of an organic thio compound collector with an alkyl mercaptan additive.

FIELD OF THE INVENTION

Froth flotation is a popular method of concentrating metals from their ores. It is believed to be the most widely used ore dressing process. The underlying principle is based on imparting a surface hydrophobicity to the mineral to be beneficiated. When air bubbles are introduced into a ground ore pulp, the hydrophobic minerals become attached to the bubbles at the air-water interface and rise, with the bubbles, to the surface where they are collected and concentrated.

Chemicals which impart hydrophobicity and facilitate flotation are generally called "promoters" or "collectors". Hereinafter, these chemicals will be referred to as collectors.

Certain collectors have collector activity as well as frothing activity. In addition to their collector activity, the alkyl mercaptans are quite froth supressing. This suppresant activity produces a flat, oily froth which is difficult to control and results in increased frother consumption. This deleterious effect on the formation of a workable froth bed renders the alkyl mercaptans undesirable as collectors in commercial applications. However, when used in combination with other collectors, the alkyl mercaptans, surprisingly, demonstrate a synergistic improvement in the activity of the other collectors. This improvement occurs only when the alkyl mercaptan is added to the ore pulp in the presence of another collector. Hereinafter, a compound which imparts a synergistic improvement to the activity of another collector will be referred to as a "collector additive." As collector additives, then, the alkyl mercaptans provide better recoveries than that obtained with the unaided collectors.

SUMMARY OF THE INVENTION

Accordingly, it is an object of this invention to provide a flotation method wherein a collector additive is employed which achieves improved recovery of metal values.

Another object is to provide an improved method of beneficiating metal values from all ores on which froth flotation is effective.

It is a further object to provide a method of flotation with high selectivity towards iron sulfide ores.

A more particular object is to provide a flotation method which will efficiently beneficiate both chalocite and chalcopyrite ores.

A further object is to provide a method of flotation employing collectors having a high affinity for fine particles of minerals not readily collected by other collectors.

Still another object is to provide an effective method of flotation under conditions where slime interference necessitates higher quantities of water soluble collectors.

It is a more specific object to provide a flotation method employing a collector which satisfactorily collects copper, lead, zinc, molybdenum sulfide and precious metals while collecting less iron sulfides than water soluble collectors.

It is still further object to impart improved flotation kinetics by employing a collector additive.

It is a still a more particular object to provide a collector additive which imparts significantly faster mineral loading coupled with a greater tendency to floculate more readily, thereby increasing this removal into concentrate.

These and other objects hereinafter disclosed are met by the invention wherein there is provided a mixture of (I) a collector selected from the class consisting of at least one of (A) an alkyl xanthogen alkyl formate having the general formula:

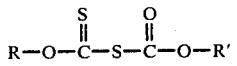

wherein R is a branched or straight chain alkyl substituent having 1 to 6 carbon atoms and R′ is selected from the class consisting of one of ethyl and methyl; and (B) a dialkyl thionocarbamate of the formula:

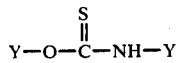

wherein Y is a branched or straight chain alkyl substituent having 1 to 6 carbon atoms and Y′ is selected from the class consisting of one of ethyl and methyl; and (II) an alkyl mercaptan having the formula:

wherein Z is a branched or straight chain alkyl substituent having 4 to 16 carbon atoms. For example, a mixture may consist of from 0 to 95 percent by weight of isobutyl xanthogen ethyl formate and from 95–0 percent by weight of N-methyl-O-ethyl thionocarbamate mixed with 5 percent by weight dodecyl mercaptan.

Any number of different alkyl xanthogen alkyl formates or dialkyl thionocarbamates may be used. The synergistic activity of the alkyl mercaptan is best utilized at concentrations in the range of greater than or equal to 0.5% but less than 10 percent by weight, and preferably between 3.0% and 5.0% by weight. As will be disclosed hereafter, the synergistic effect of alkyl mercaptan is demonstrated by the presence and absence of the alkyl mercaptan on the collector activity of alkyl xanthogen alkyl formate alone or as a mixture with dialkyl thionocarbamate. An unexpectedly significant increase in recovery is obtained by addition of the alkyl mercaptan.

Typical alkyl xanthogen alkyl formate compounds include:

isobutyl xanthogen ethyl formate
ethyl xanthogen ethyl formate
isopropyl xanthogen methyl formate.

Typical dialkyl thionocarbamate compounds include:

N,O dimethyl thionocarbamate
N,O-diethyl thionocarbamate
N-methyl-O-ethyl thionocarbamate.

Typical alkyl mercaptan compounds include: Dodecyl mercaptan.

Alkyl xanthogen alkyl formates are excellent collectors. These compounds exhibit a high affinity for exceptionally fine particles of valuable minerals not readily collected by the water soluble alkyl xanthate and dialkyl dithiophosphate collectors. Because the alkyl xanthogen alkyl formates are water insoluble oils, they are not as prone to depletion by slime interference present in highly oxidized ore bodies. This property results in improved metal recoveries at lower dosage levels than that achieved by the water soluble alkyl xanthates and dialkyl dithiophosphate collectors. Moreover, the alkyl xanthogen alkyl formates are highly selective toward iron sulfides. Thus, unlike the alkyl xanthates, they will satisfactorily collect a wide range of metals including, but not limited to, copper, lead, zinc, molybdenum sulfide and the precious metals while collecting lesser amounts of undesirable iron sulfide.

The dialkyl thionocarbamates exhibit properties highly similar to the alkyl xanthogen alkyl formates. They are water insoluble oils with excellent collection abilities. The dialkyl thionocarbamates, however, demonstrate a particular affinity for chalocite ores, whereas the alkyl xanthogen alkyl formate have a high affinity for chalcopyrite. Thus, flotation of chalcocite ores is best obtained by utilizing the dialkyl thionocarbamates, while flotation of chalcopyrite ores is best obtained with alkyl xanthogen alkyl formate collectors.

Accordingly, the present invention improves the collector activity of the alkyl xanthogen alkyl formate and dialkyl thionocarbamates through a synergistic action of unknown mechanism. Visually, the effect of the alkyl mercaptan collector additive is to improve flotation kinetics. This change is characterized by a significantly faster loading of minerals into the froth, a greater tendency to flocculate, and, therefore, an improved rate of removal of the mineral into the concentrate.

While the invention is quite valuable for the concentration of copper, addition of the alkyl mercaptan will also facilitate flotation and concentration of metals such as lead, zinc, molybdenum, and gold and silver from their ores.

The invention is further illustrated by but not limited to the following examples:

EXAMPLE I

A. 800 g of 10 mesh Asarco (Mission) ore (2.63% Cu) was ground in a ball mill to 25.6%+100 mesh.

10 mg total collector of composition: 80% isobutyl xanthogen ethyl formate and 20% of a blend of N-ethyl-O-isopropyl and N-methyl-O-isobutyl thionocarbamates was mixed with 0.5 mg dodecyl mercaptan additive and 20 mg methyl isobutyl carbinol (MIBC) frother was added, with sufficient lime to bring the pH to 10.0. The resulting mixture was floated for 4 minutes in a 2.0 l Wemco flotation machine at 1000 RPM. The resulting concentrate yielded a copper recovery of 76.8%. The weight percentage of copper in the concentrate was 7.66%.

B. The same procedures as Example A, except the dodecyl mercaptan additive was omitted. The resulting concentrate yielded a copper recovery of 74.3%. The weight percentage of copper in the concentrate was 8.67%.

EXAMPLE II

A. 700 g of 10 mesh Phelps Dodge (Morenci 0.428% Cu) ore was ground in a ball mill to 25%+60 mesh. 5 mg total collector of the same composition as Example 1 was mixed with 0.25 mg dodecyl mercaptan and 25 mg "Ore Prep F521" Frother manufactured by OrePrep. Sufficient lime was added to bring to pH 10.5.

The resulting copper concentrate recovery was 59.4%. The weight percentage of copper in the concentrate was 7.22%.

B. The same procedures as part A, except the dodecyl mercaptan was omitted. Concentrate copper recovery was 58.79%. The weight percentage of copper in the concentrate was 7.00%.

EXAMPLE III

A. 700 g of 10 mesh Kennecott (Chino 0.87% Cu) ore was ground in a ball mill to 28%+100 mesh. 5 mg collector having the same composition as in Example 1 was mixed with 0.25 mg dodecyl mercaptan and 30 mg Chino plant proprietary frother was mixed with sufficient lime to bring to pH 9.8. The resulting copper concentrate recovery was 82.6%. The weight percentage of copper in the concentrate was 7.94%.

B. The same procedures were followed as in A, except that the dodecyl mercaptan additive was omitted. Concentrate copper recovery was 82.4%. The weight percentage of copper in the concentrate was 7.60%.

C. The same procedures were followed as in A except the collector composition was 100% thionocarbamate blend of N-ethyl-O-isopropyl and N-methyl-O-isobutyl thionocarbamates. Concentrate copper recovery was 82.4%. The weight percentage of copper in the concentrate was 7.94%.

D. The same procedures as in C, except that the dodecyl mercaptan was omitted. Concentrate copper recovery was 81.5%. The weight percentage of copper in the concentrate was 7.60%.

EXAMPLE IV

A. 700 g. Phelps Dodge (Morenci 0.55% Cu) ore was ground in a ball mill to 32%+65 mesh. 6 mg of collector having a composition of 100% of a blend of N-ethyl-O-isopropyl thionocarbamate and N-methyl-O-isobutyl thionocarbamate was mixed with 0.3 mg dodecyl mercaptan, 30 mg "OrePrep F523" frother manufactured by OrePrep, and sufficient lime to bring the pH to 10.2. Flotation as in Example I, resulting concentrate copper recovery was 58.1%. The weight percentage of copper in the concentrate was 6.08%.

B. Same procedures as followed as in A above, except the dodecyl mercaptan was omitted. Resulting concentrate copper recovery was 57.7% Cu. The weight percentage of copper in the concentrate was 5.63%.

EXAMPLE V

A. 700 g. of Anamax (Twin Buttes 1.15% Cu) 10 mesh ore was ground in a ball mill to 6.5%+65 mesh, 10 mg of 100% ethyl xanthogen ethyl formate collector, 20 mg MIBC frother and 0.5 mg dodecyl mercaptan were mixed as in Example I. Concentrate copper recovery was 91.8% Cu. The weight percentage of copper in the concentrate was 21.83%.

B. Same procedures were followed as in (A) above except the dodecyl mercaptan was omitted. Concentrate copper recovery was 87.9% Cu. The weight percentage of copper in the concentrate was 20.86%.

The herein described flotation procedures are given by way of illustration only, since any ore dressing flotation technique may be used as long as the presently described alkyl xanthogen alkyl formate and dialkyl thionocarbamate collectors are employed with alkyl mercaptan as a collection additive.

What is claimed is:

1. A method of beneficiating copper from copper-bearing ore by froth flotation, whereby flotation is conducted in the presence of synergistic mixture of a collector blend and a collector additive, said collector being a blend of: (A) about 80% by weight of an alkyl xanthogen alkyl formate of the formula $$X-O-\overset{\overset{\displaystyle S}{\|}}{C}-S-\overset{\overset{\displaystyle O}{\|}}{C}-O-X'$$

wherein X is a branched or straight chain alkyl substituent having 1 to 6 carbon atoms, and X' is an alkyl substituent selected from the class consisting of one of methyl and ethyl, and (B) about 20% by weight of a dialkyl thionocarbamate of the formula $$Y-O-\overset{\overset{\displaystyle S}{\|}}{C}-NH-Y$$

wherein Y is a branched or straight chain alkyl substituent having 1 to 6 carbon atoms, and Y' is an alkyl substituent selected from the class consisting of one of methyl and ethyl; said collector additive comprising an alkyl mercaptan of the formula $$Z-SH$$

wherein Z is a branched or straight chain alkyl substituent having 4 to 16 carbon atoms, said alkyl mercaptan comprising about 5% by weight of said synergistic mixture of said collector and said collector additive.

2. The method of claim 1, further limited in that the collector composition is 80% isobutyl xanthogen ethyl formate and 20% of a blend of N-ethyl-O-isopropyl thionocarbamate and N-methyl-O-isobutyl thionocarbamate.

3. The method of claim 1, further limited in that the alkyl mercaptan is dodecyl mercaptan.

4. The method of claim 1, further limited in that the metal ore is chalcopyrite.

5. The method of claim 1, further limited in that the metal ore is chalcocite.

6. The method of claim 1, further limited in that the metal is copper.

7. A synergistic mixture of a collector blend and a collector additive for beneficiating copper from copper-bearing ore by froth flotation, said collector being a blend of: (A) about 80% by weight of an alkyl xanthogen alkyl formate of the formula $$X-O-\overset{\overset{\displaystyle S}{\|}}{C}-S-\overset{\overset{\displaystyle O}{\|}}{C}-O-X'$$

wherein X is a branched or straight chain alkyl substituent having 1 to 6 carbon atoms, and X' is an alkyl substituent selected from the class consisting of one of methyl and ethyl, and (B) about 20% by weight of a dialkyl thionocarbamate of the formula $$Y-O-\overset{\overset{\displaystyle S}{\|}}{C}-NH-Y$$

wherein Y is a branched or straight chain alkyl substituent having 1 to 6 carbon atoms, and Y' is an alkyl substituent selected from the class consisting of one of methyl and ethyl; said collector additive comprising an alkyl mercaptan of the formula $$Z-SH$$

wherein Z is a branched or straight chain alkyl substituent having 4 to 16 carbon atoms, said alkyl mercaptan comprising about 5% by weight of said synergistic mixture of said collector and said collector additive.

8. The synergistic mixture of claim 7, wherein said collector composition is 80% isobutyl xanthogen ethyl formate and 20% of a blend of N-ethyl-O-isopropyl thionocarbamate and N-methyl-O-isobutyl thionocarbamate.

9. The synergistic mixture of claim 7, wherein said alkyl mercaptan is dodecyl mercaptan.

10. The method of claim 7, further limited in that the metal ore is chalcocite.

11. The method of claim 7, further limited in that the metal is copper.

* * * * *